US008436779B2

(12) United States Patent
Clifford et al.

(10) Patent No.: US 8,436,779 B2
(45) Date of Patent: May 7, 2013

(54) APPARATUS FOR ALIGNING AN ANTENNA IN A REFERENCE POSITION

(76) Inventors: Bruce Kenneth Clifford, Brampton (CA); Mark Frischman, Thornhill (CA)

( * ) Notice: Subject to any disclaimer, the term of this patent is extended or adjusted under 35 U.S.C. 154(b) by 0 days.

(21) Appl. No.: 13/051,865

(22) Filed: Mar. 18, 2011

(65) Prior Publication Data

US 2011/0225804 A1 Sep. 22, 2011

Related U.S. Application Data

(60) Provisional application No. 61/315,581, filed on Mar. 19, 2010.

(51) Int. Cl.
*H01Q 3/00* (2006.01)

(52) U.S. Cl.
USPC ..... 343/765; 343/766; 343/880; 29/600; 29/729

(58) Field of Classification Search ..... 29/729–739, 29/600; 343/882, 890, 892; 248/219.4, 219.1
See application file for complete search history.

(56) References Cited

U.S. PATENT DOCUMENTS

| | | | | |
|---|---|---|---|---|
| 4,489,910 | A * | 12/1984 | Ferguson | 248/219.4 |
| 6,232,928 | B1 * | 5/2001 | Zimmerman et al. | 343/882 |
| 6,262,961 | B1 * | 7/2001 | Maeda et al. | 720/628 |
| 6,897,828 | B2 * | 5/2005 | Boucher | 343/890 |
| 2011/0225804 | A1 * | 9/2011 | Clifford et al. | 29/593 |

* cited by examiner

*Primary Examiner* — Minh Trinh

(57) ABSTRACT

The present invention is an apparatus operable to align an antenna and to retain the antenna in a reference position during alignment of the antenna. The apparatus may include a bracket having an arm attached thereto, and the arm conforms to the back wall of an antenna. An engagement means and/or securing means may be incorporated in the apparatus to retain the position of the antenna in a fixed or removeable connection with the apparatus. An alignment device being operable to align the antenna may be attached to the bracket. The apparatus of the present invention may be arranged or otherwise positioned in accordance with a reference position. Said reference position may be defined as a position that is selected in reference to a reference point, line, or plane of the antenna. The apparatus may retain the antenna in a reference position during alignment of the antenna.

15 Claims, 18 Drawing Sheets

APPARATUS FOR ALIGNING AN ANTENNA IN A REFERENCE POSITION

This application claims the benefit of U.S. Provisional Patent Application Ser. No. 61/315,581 filed Mar. 19, 2010.

FIELD OF THE INVENTION

The present invention relates to an apparatus for antenna positioning, and more specifically to an apparatus for maintaining an antenna in a specific position.

BACKGROUND OF THE INVENTION

Wireless communications enable information to be exchanged using wireless devices, such as cellular telephones and Internet-enabled smart phones. With the ever-increasing demand for wireless bandwidth, it is becoming increasingly important to ensure that wireless networks are optimally deployed.

Typically, wireless communication networks comprise a plurality of telecommunications antennae mounted high above antenna masts, transmission towers, and tall buildings. Each antenna is typically a panel antenna designed to serve a specific area, which in the case of cellular communications is referred to as a cell. The strength of the signal available to wireless devices within the cell is in part based on the precision of the installation of the antenna.

To optimize the strength and bandwidth of the signal, the panel antenna must be properly aligned when it is installed. Due to wind and movement during servicing, the antenna must also be realigned from time to time. Alignment involves both pointing the antenna at a particular azimuth and at a particular mechanical tilt. Even small errors in the azimuth alignment will cause a significant degradation in signal quality. Mechanical tilt errors are not as critical since a mechanical tilt error is typically controlled electronically as well as mechanically.

A multitude of prior art solutions are currently in use for azimuth alignment of panel antennae. Currently, the most accurate alignment apparatus are those that are mounted directly to the antenna during installation and servicing.

Sunsight™ is the manufacturer of one such system that can be mounted either to the side or top of the antenna. The Sunsight system includes GPS antennae that are used to determine the azimuth of the panel antenna to be aligned. When mounted to the side of the antenna (see FIG. 1 that shows the Sunsight system 10), multipath errors are introduced because the GPS antenna are disposed below the antenna to be aligned. When mounted on top of the antenna to be aligned, there can be no guarantee that the system is aligned along a plane from which azimuth is measured, as the top of the antenna may not be completely flat or parallel to such a plane. Furthermore, the system includes a plurality of buttons that, when pressed with any force, will cause the system to be out of alignment. The specifications of the prior art may include: Azimuth accuracy +/−2.0°; Tilt accuracy +/−0.25°; Roll accuracy +/−0.25°; Height accuracy +/−1' @300"; and Weight 5 lbs.

SPAA™ is another manufacturer of an alignment system. FIG. 2 illustrates a SPAA alignment system 12. This system comes closer to measuring an accurate azimuth than the Sunlight system. It includes two arms, one of which braces the back panel of the antenna and the other which braces the front panel of the antenna. An arm configured to hold an electronic pointing system extends from the front arm. There may be exposed cable on the arms, and a clamp for mounting may be flat on both sides. This prior art example may be unable to guarantee orthogonality with respect to the back surface of the system. The front plate may be where the system is referenced. A user may be required to reach around the atenna to attach the system. The shape and configuration of antennae cause a problem for the SPAA to provide precise alignment.

First, antennae are typically not of trapezoidal cross section. This means that the front panel and back panel of the antennae are not usually parallel. In fact, the front panel is typically curved or of some shape other than flat. Maintaining the two arms in exact parallel alignment is very difficult and even a small misalignment can produce an inaccurate result.

Secondly, antennae are usually designed such that the electronic components in the antennae are disposed toward the back panel or disposed with reference to the back panel. Aligning a pointing device with the front panel can never guarantee that the back panel is aligned. Thus, alignment of the front panel will not necessarily provide the optimal antenna alignment.

SUMMARY OF THE INVENTION

In one aspect, the present disclosure relates to an apparatus for retaining an antenna in a reference position during alignment of the antenna, said apparatus comprising: a bracket being conformable to a back wall of the antenna; a securing means attached to the bracket, said securing means being operable to retain the antenna in the reference position; and an alignment device attached to the mounting bracket, said alignment device being operable to align the antenna.

In another aspect, the present disclosure relates to a method for retaining an antenna that is secured to an apparatus in a reference position during alignment of the antenna, said method comprising the following steps: a user attaching the antenna to the apparatus by a securing means in a manner that causes a back wall of the antenna to abut a bracket of the apparatus; utilizing a reference of the antenna to arrange the apparatus to cause the antenna to be retained in the reference position; connecting an alignment device with the bracket of the apparatus; and aligning the antenna retained in the reference position in accordance with the alignment device.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE DRAWINGS

The invention will be better understood and objects of the invention will become apparent when consideration is given to the following detailed description thereof. Such description makes reference to the annexed drawings wherein.

Figure 1:
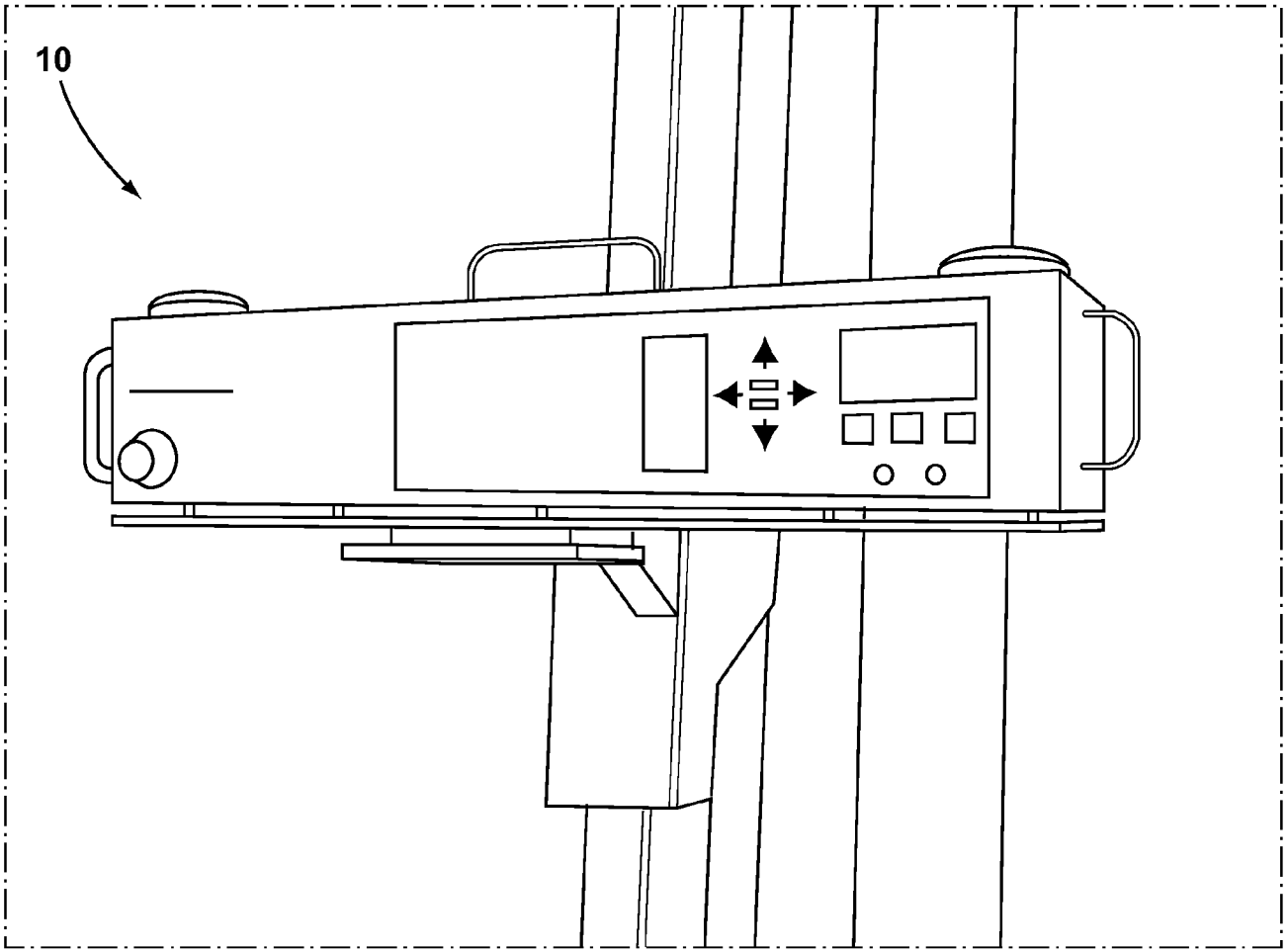
FIG. 1 (PRIOR ART)
FIG. 1 illustrates a prior art system for aligning a panel antenna.
Figure 2:
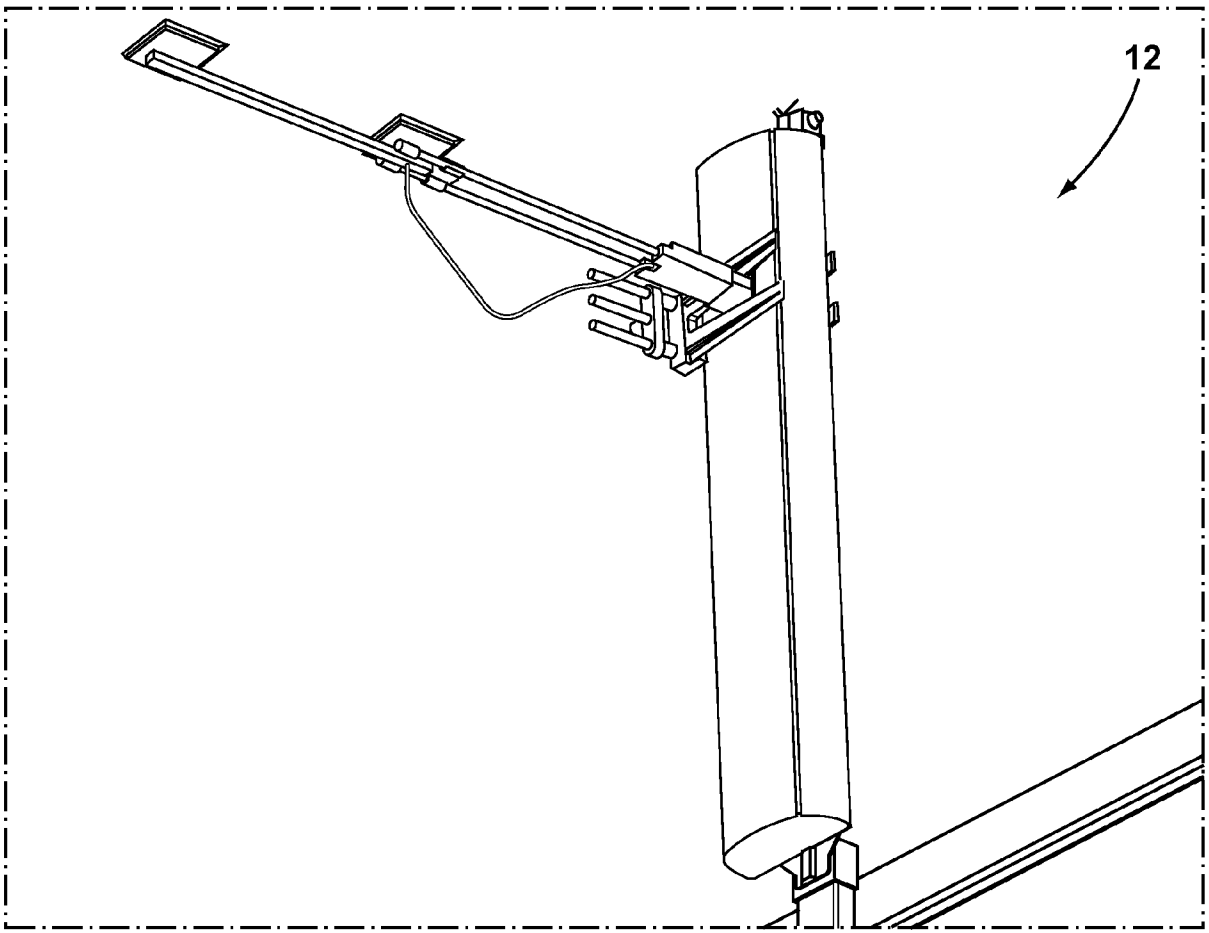
FIG. 2 (PRIOR ART)
FIG. 2 illustrates another prior art system for aligning a panel antenna.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

The present invention is an apparatus operable to align an antenna and to retain the antenna in a reference position during alignment of the antenna. The apparatus may include a bracket, or mounting brace, having an arm attached thereto, and the arm conforms to the back wall of an antenna. An engagement means and/or securing means may be incorporated in the apparatus to retain the position of the antenna in a fixed or removeable connection with the apparatus. An alignment device being operable to align the antenna may be attached to the bracket. The apparatus of the present invention may be arranged or otherwise positioned in accordance with a reference position. Said reference position may be defined as a position that is selected in reference to a reference point, line, or plane of the antenna. The apparatus may retain the antenna in a reference position during alignment of the antenna.

The present invention may be an apparatus for aligning an antenna. For example, the antenna may be of many varieties, such as a panel antenna, directional antenna, multi-directional antenna, parabolic, antenna arrays or omni-directional antenna. The apparatus may comprise a bracket, a securing mechanism and an alignment device. The bracket may be adapted to conform to the back wall of the antenna. The securing mechanism may be adapted to secure the bracket to the antenna by conforming to the front wall of the antenna or a housing of the antenna. The alignment device may be coupled to the bracket for determining the alignment of the antenna.

The antenna may include a housing defined by one or more walls. Generally, a panel antenna may have a front wall and a substantially flat back wall, although other cross-sectional profiles are possible in which case the present invention discloses modifications to the apparatus described. The front wall may be, in part, curved or contoured and may be connected at its sides to the sides of the back wall so as to form a continuous cross-sectional profile. Alternatively, one or more side walls may also be provided on the antenna disposed between the back wall and the front wall. Other antennae that may be aligned by the apparatus of the present invention include directional antenna, multi-directional antenna, parabolic antenna, antenna arrays and omni-directional antennae that have a housing defined by one or more walls in which none of the walls are required to be substantially flat.

The present invention may provide an apparatus for retaining an antenna in a reference position even during the aligning of the antenna. The antenna may include a substantially flat back wall and a front wall. The apparatus may include: a bracket adapted to conform to the back wall of the antenna; a securing mechanism adapted to secure the bracket to the antenna by conforming to the front wall of the antenna; and an alignment device coupled to the bracket for determining the alignment of the back wall of the antenna. The securing mechanism may comprise a flexible strap disposed around said antenna.

The present invention may provide an apparatus for aligning an antenna and said antenna may have a housing defined by one or more walls. The apparatus may include: a bracket adapted to be arranged against at least one wall of the housing; a securing mechanism that includes a flexible strap adapted to secure the bracket to the housing; and an alignment device coupled to the bracket for determining the alignment of the back wall of the antenna.

The present invention may also provide a system and/or apparatus for mounting equipment precisely to a base having specific geometry. For example, the equipment may be an antenna.

The apparatus of the present invention may be operable to undertake the alignment of a panel antenna. Such alignment may be performed, so that the alignment is in reference to alignment with the back wall of the antenna. Typically, electronic components of the antenna may be disposed along or relative to the back wall of the antenna. Therefore, the apparatus of the present invention may optimize alignment of the antenna by undertaking to position the antenna in connection with the apparatus in reference to the back wall of the antenna. This aspect of the present invention may provide a benefit over the prior art which does not position an antenna in reference to the back wall of the antenna.

The present invention may offer a further benefit over the prior art in that it may be operable to achieve a precise alignment. The prior is unable to achieve such a precise alignment due to the fact that prior art apparatuses generally do not attach to the back of the antenna. The present invention may be an apparatus that attaches to the back of the antenna. As described herein, this attachment may allow for reference positioning and other alignment benefits that may result in a precise alignment of a antenna that is not possible by utilizing the prior art.

Yet another benefit of the present invention over the prior art that may be offered by the present invention is that the present invention may be operable to be utilized with a variety of type of antenna, and to undertake to align each type of antenna. For example, the present invention may be operable to align one or more of the following: directional antenna; multi-directional antenna; parabolic antenna; antenna arrays;

or omni-directional antenna. The alignment of the antenna by the present invention may be achieved based on alignment of the apparatus to a reference point, line or plane of the antenna. The result may be a reference positioning of the antenna when it is attached to the apparatus. For example, a user may arrange the positioning of the apparatus of the present invention with reference to the reference point, line or plane of the antenna. The antenna may be secured to apparatus and the antenna may thereby be retained in a reference position during alignment of the antenna. Prior art apparatuses is generally operable with one type of antenna and is not operable with the variety of antenna types that the present invention may be operable to align.

A further benefit of the present invention over the prior art may be that the apparatus of the present invention may be used for mounting devices, other than alignment devices, to the antenna with reference to the back wall of the antenna. The prior art does not offer the type of mounting options that are presented by the present invention.

A skilled reader will recognize that while the following description focuses on providing an apparatus for an alignment device, the present invention may have other possible applications as well. The apparatus may include a bracket adapted to conform to the back wall of the antenna. The back wall of the antenna may be flat, in which case the bracket may be adapted to conform to the flat back wall. In embodiments of the present invention adaptable to antenna that do not have a flat back wall, and the back wall of the antenna is a different shape, for example, such as a curved shape, the present invention may include an arm or bracket that conforms to the curved shape of the antenna. The present invention may modify its shape or include a means that may follow the contour of the back wall of the antenna and to maintain this contour. A skilled reader will recognize that other means may be incorporated in embodiments of the present invention to allow for use of the present invention with antenna that do not have flat back walls.

Figure 18:
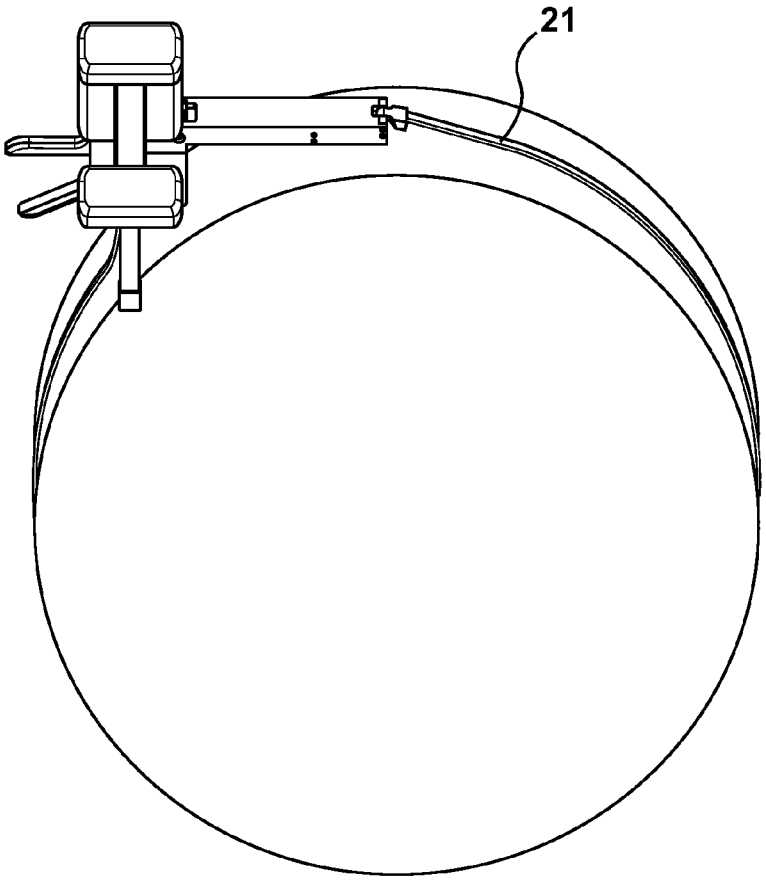
FIG. 18 illustrates a front view of the arrangement shown in FIG. 14.

In embodiments of the present invention, the bracket may be secured to the antenna by a securing mechanism that conforms substantially to the front wall of the antenna. For example, as shown in FIG. 18, the securing mechanism may include a flexible strap 21 that conforms to one or more walls of the antenna, for example, such as a front wall and one or more side walls, depending on the shape of the antenna. An alignment device may be coupled to the bracket. The alignment device may be operable to determine the alignment of the antenna with reference to the back wall of the antenna.

The apparatus may also be adapted for use with antennae having other wall geometries wherein the bracket does not conform to a wall of the antenna. The securing mechanism may cause the apparatus to be substantially securely retained to the antenna. The apparatus may be utilized for alignment of the antenna even though the bracket may not conform to a wall of the antenna.

Figure 4:
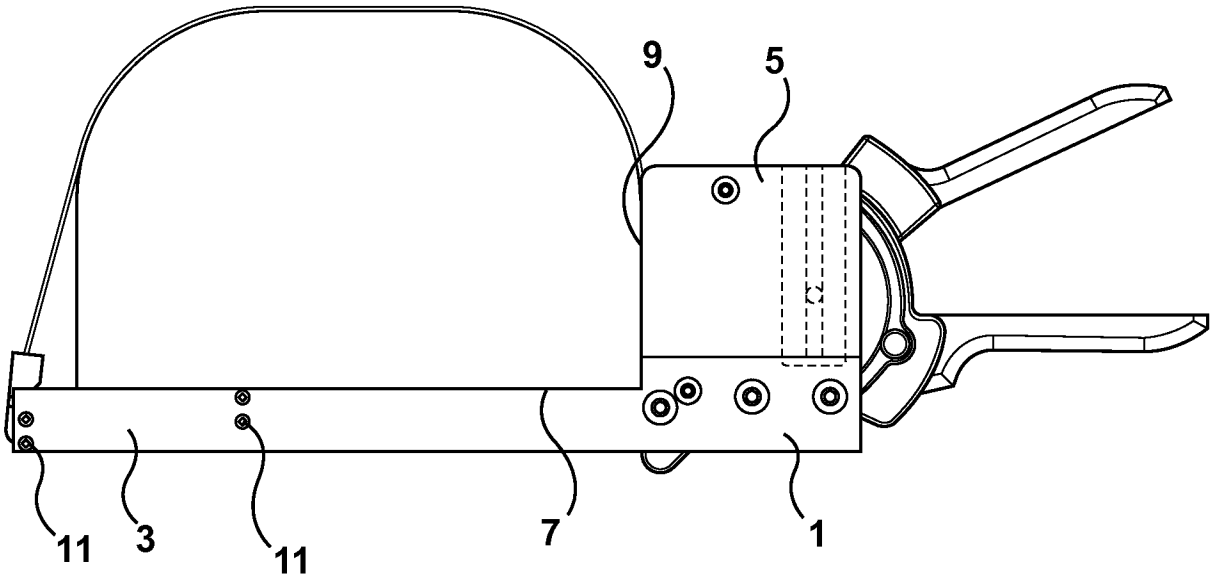
FIG. 4 illustrates a cross sectional top view of the arrangement shown in FIG. 3.

As shown in FIG. 4, in one embodiment of the present invention elements of the apparatus may surround an antenna. A bracket 1 may be include an arm 3 adapted to conform to the back wall of the antenna. Typically, the arm may have a planar profile to conform to a substantially flat back wall. The arm may be of any length but preferably, but not necessarily, is at least at long as the width of the back wall. The bracket may be used with various sizes of antennae, in which case the arm is preferably, but not necessarily, at least as long as the longest back wall with which it is to be used.

The bracket 1 may also preferably include one or more additional arms that conform to one or more walls of the antenna adjoining the back wall of the antenna, such that the arm 3 and the one or more additional arms collectively conform to the back wall and one or more other walls of the antenna. The arm and the one or more additional arms may abut the outside of the antenna along the lines defined by the back wall and the one or more adjoining walls. The back wall may constitute the reference point, as described herein.

Figure 7:
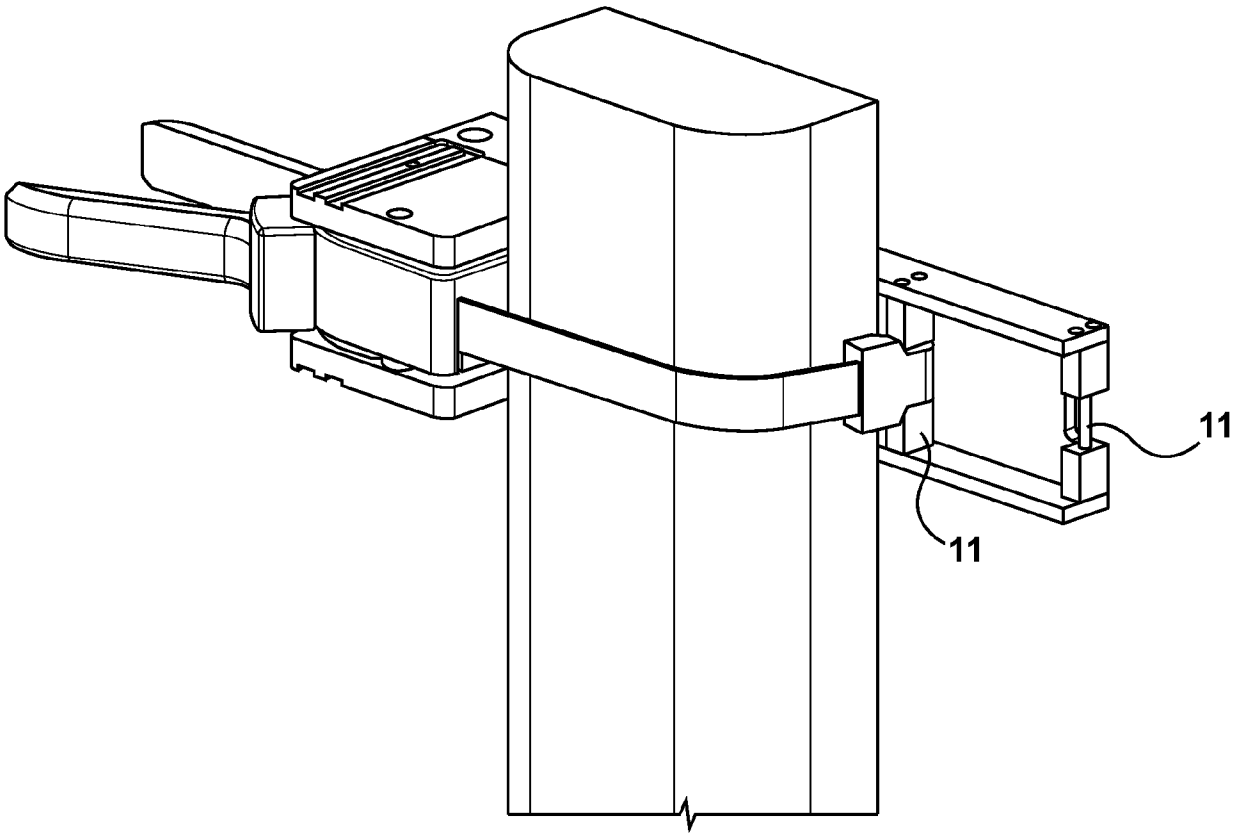
FIG. 7 illustrates an arm having at least two fasteners longitudinally spaced apart along the arm.

The arm may include one or more fasteners or fastening means 11 that spaced along the arm, for example, such as longitudinally spaced apart. The one or more fasteners or fastening means may be provided within the arm. Such one or more fasteners or fastening means may be provided in the arm in a manner whereby they do not disrupt the planar profile of the arm. The fasteners or fastening means may be integrally formed within the arm or fixedly secured to the arm. The fasteners or fastening means may be of several types. For example, the fasteners may be one or more longitudinally spaced apart vertical posts. A plurality of posts may be provided for accommodating antennae of different widths, as it may be preferable to use a fastener in proximity of the side of the back wall of the antenna. As shown in FIG. 7, the present invention may include an arm having at least two fasteners 11 longitudinally spaced apart along said arm.

Figure 3:
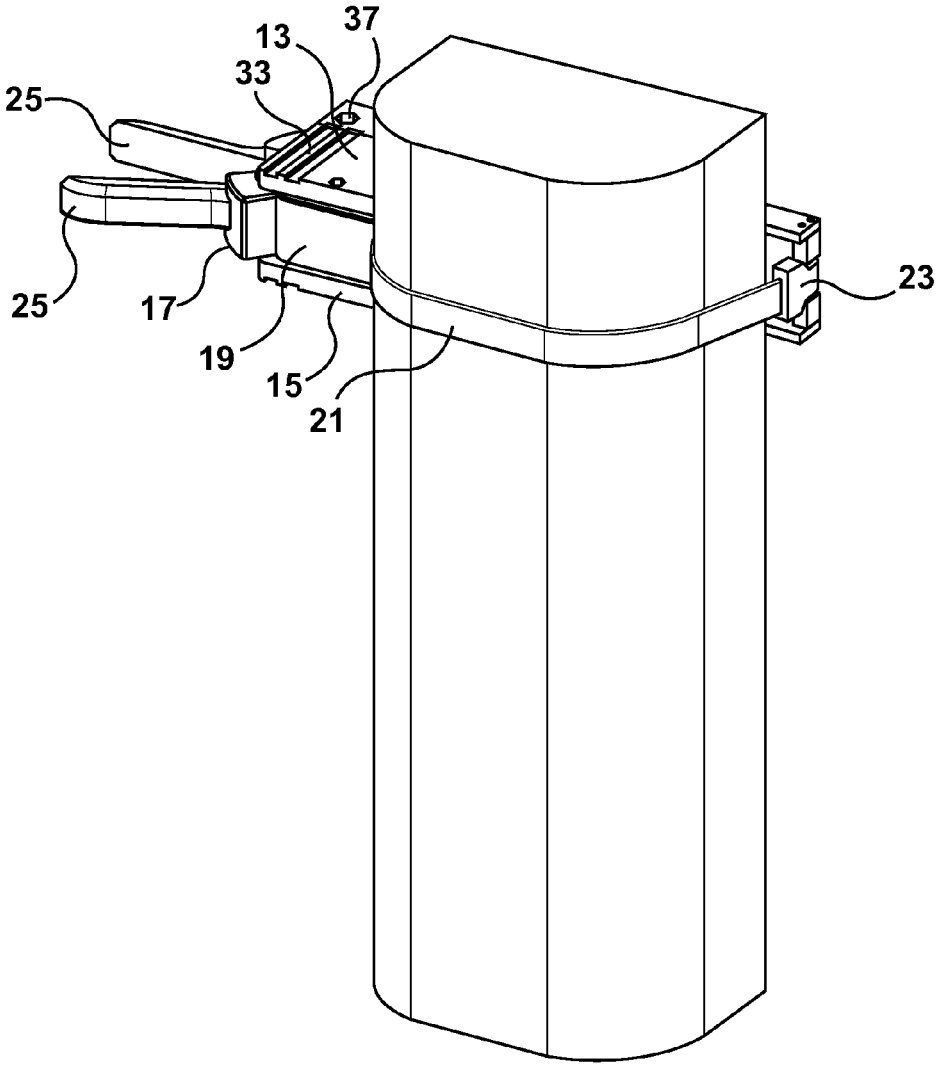
FIG. 3 illustrates an apparatus in accordance with the present invention disposed around an antenna.

A mounting brace 5 may be disposed substantially perpendicular to the arm 3. The mounting brace may be utilized to brace the bracket along a side wall of the antenna, or along a portion of the front wall of the antenna if a side wall is not present. As shown in FIG. 3, the mounting brace may include a top plate 13, a bottom plate 15, and a securing mechanism 17 disposed between the top and bottom plates. It should be understood that the top plate 13 and/or bottom plate 15 may be integrally formed with the arm or fixedly secured to the arm of the apparatus. As shown in FIG. 4, the arm may include an inner wall 7 and the mounting brace may include an inner wall 9. In one embodiment of the present invention the arm inner wall and/or the mounting brace inner wall may be coated or otherwise have a frictional engagement material attached thereto. The frictional engagement material may be of a variety of types, for example, such as one or more rubber or plastic strips. The frictional engagement material may be utilized to retain the position of the bracket along the back wall of an antenna when an antenna is attached to the bracket, or attached to the apparatus generally. In another embodiment of the present invention the arm the inner wall and/or the mounting brace inner wall may be formed to include knurled edges. Said knurled edges may be utilized to enhance friction between the walls of an antenna that are in contact with the arm inner wall and/or the mounting brace inner wall.

As shown in FIG. 3, the present invention may include a securing mechanism that incorporates a housing 19. The housing may have a tightening mechanism included within the housing. The present invention may further include a flexible strap 21 that is extendible from the housing and a fastener 23 that is disposed at the end of the strap.

The tightening mechanism of the present invention may be a ratcheting band clamp. The ratcheting band clamp may include one or more levers 25 operable to ratchet the strap. Ratcheting the strap may cause an extended strap to retract into the clamp. The ratcheting band clamp may also include a means for releasing or extending the strap, for example, such as a strap release lever or button. A user of the apparatus may operate the means for releasing or extending the strap and may manually extend the strap to a desired length.

In one embodiment of the present invention, the means for releasing or extending the strap may automatically extend the strap. For example, the tightening mechanism may be a winch that is operable to automatically extend and retract (tighten) the strap to an appropriate tension.

Figure 5:
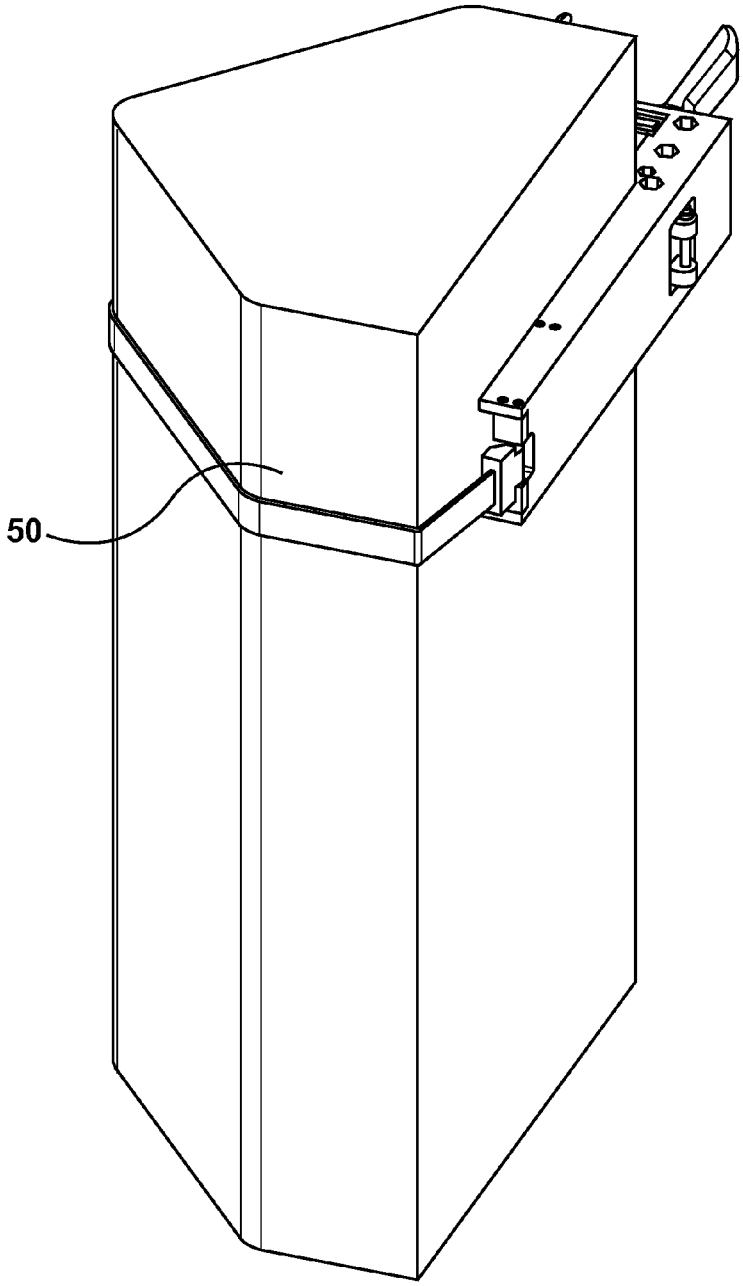
FIG. 5 illustrates an apparatus in accordance with the present invention disposed around another antenna.
Figure 6:
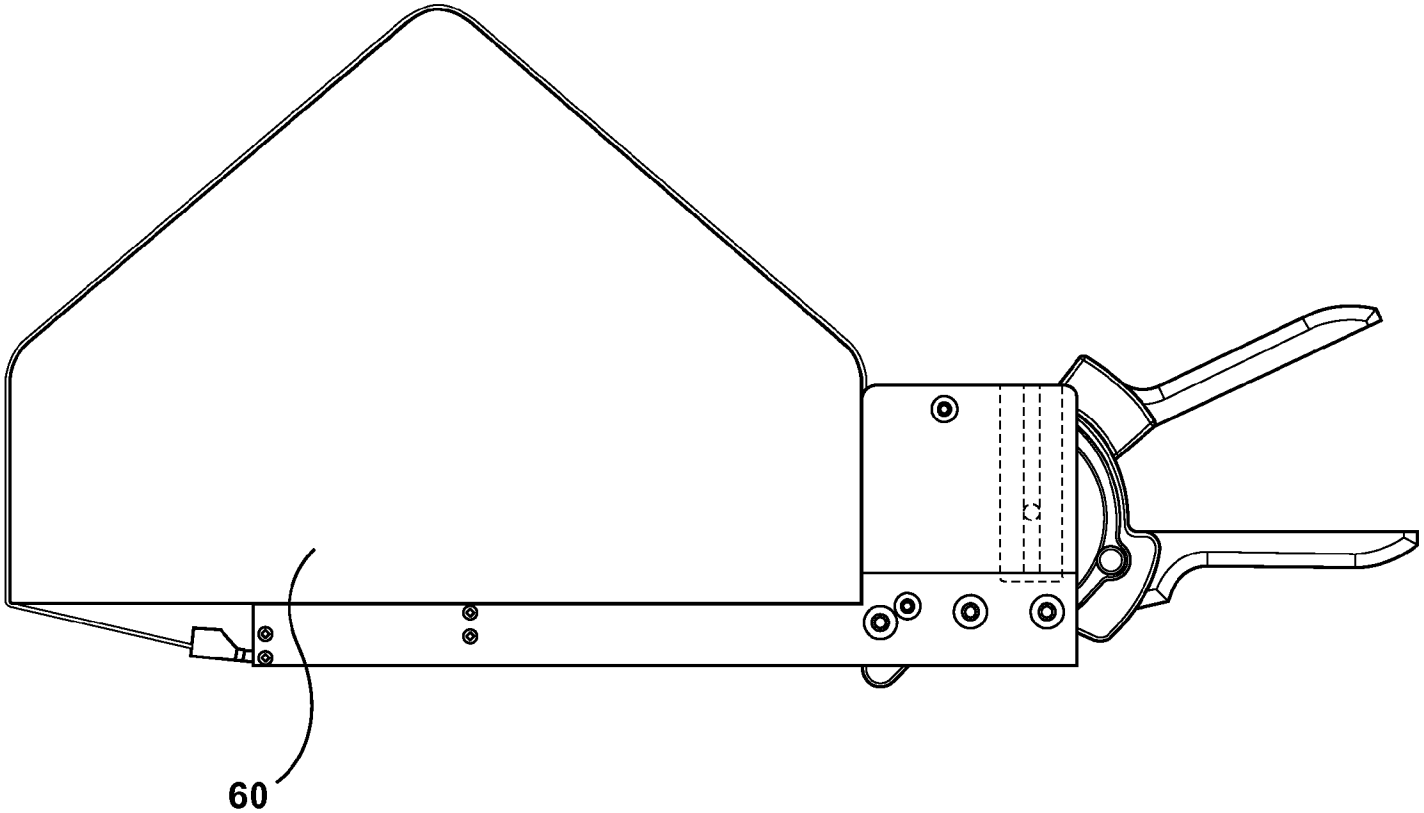
FIG. 6 illustrates a cross sectional top view of the arrangement shown in FIG. 5.

As shown in FIG. 3, the strap may be extended from the housing around the front wall of the antenna (or generally around the housing of the antenna) and the fastener 23 may be fastened to one of the fasteners positioned on the arm of the bracket. The fastener at the end of the strap may, for example, be a clip operable to fasten to the one or more posts along the arm. Once the fastener is fastened to the arm, the tightening mechanism may be used to tighten the strap around the front wall of the antenna to secure the bracket to the antenna. It should be noted that the strap may be utilized to allow the bracket to be secured to an antenna that is of a variety of widths and/or depths. For example, as shown in FIGS. 5 and 6, the apparatus of the present invention may be utilized with an antenna, 50 and 60 respectively, that is a different shape than the antenna shown in FIG. 3. A skilled reader will recognize that the present invention may be utilized to attach to a variety of types of antenna that are a variety of shapes and sizes.

Figure 8:
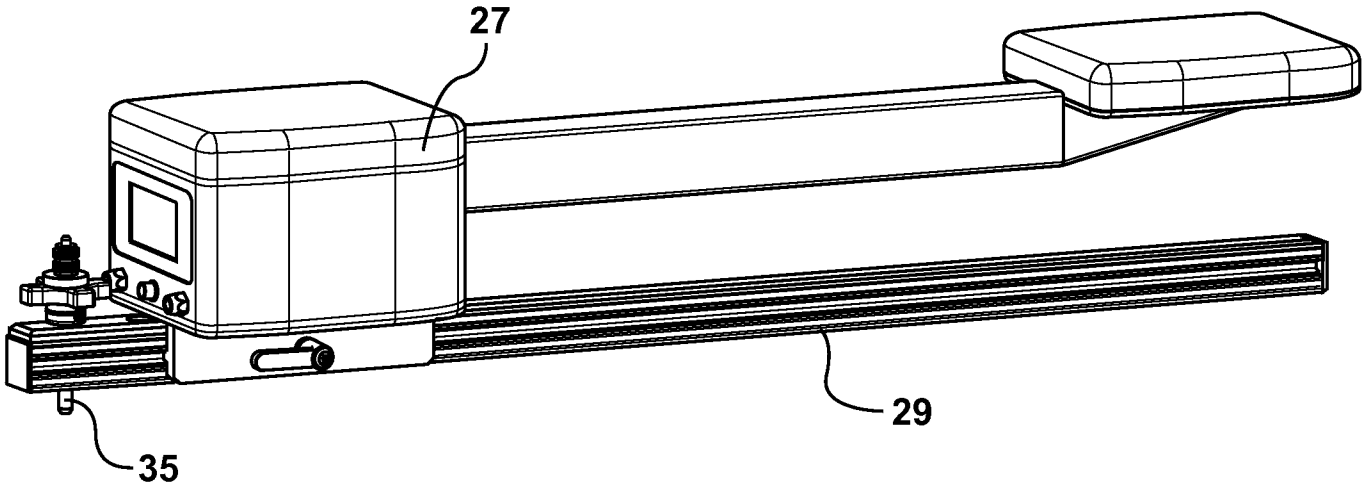
FIG. 8 illustrates an alignment device in accordance with the present invention.
Figure 10:
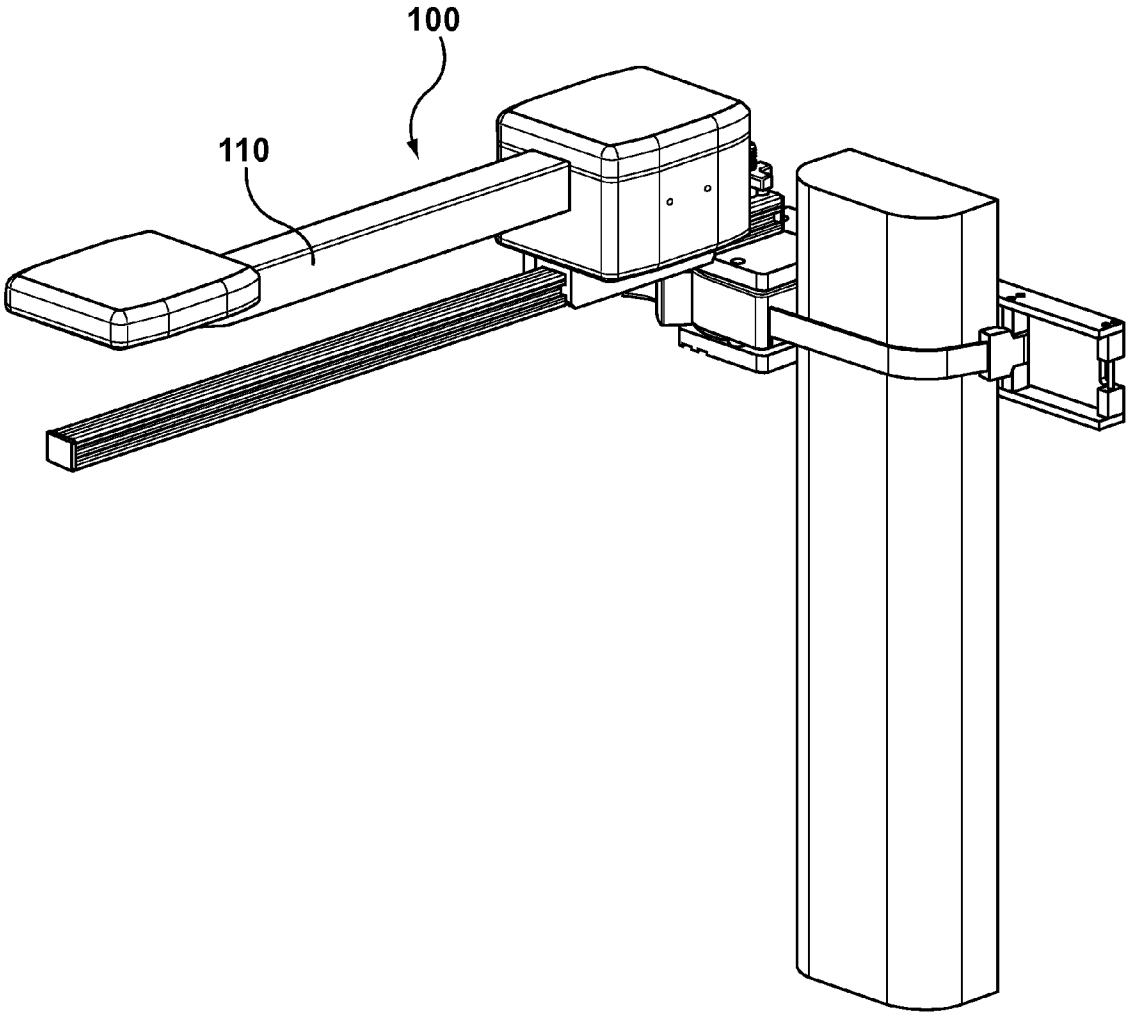
FIG. 10 illustrates the pointing device in a non-extended configuration.

The present invention may include an alignment device. As shown in FIG. 10, the alignment device 100 may be attached to the mounting brace of the apparatus. The alignment device may be of several different types, for example, such as an optical scope, a reflector for surveying, one or more prisms for surveying; prism poles for surveying, one or more cameras, one or more mirrors, a laser pointer, etc. The alignment device may be operable to align the antenna. As shown in FIG. 8, the alignment device may include a pointing device, for example such as an azimuth pointing device 27 which is known in the art. As a further example, the azimuth pointing device may be a GPS enabled device. A skilled reader will recognize that other alignment devices, including alignment devices that do not include an azimuth pointing device, may be incorporated in the present invention.

The alignment device may include an alignment device arm 29 on which the pointing device may be disposed. The pointing device may be moveable to a variety of positions. For example, the pointing device may be slideably attached to the alignment device arm. The pointing device may be moved by sliding along the alignment device arm. Moving of the pointing device may cause positioning of the pointing device at a variety of distances away from the antenna. Positioning the pointing device at particular distances away from the antenna may provides increased accuracy.

Figure 9:
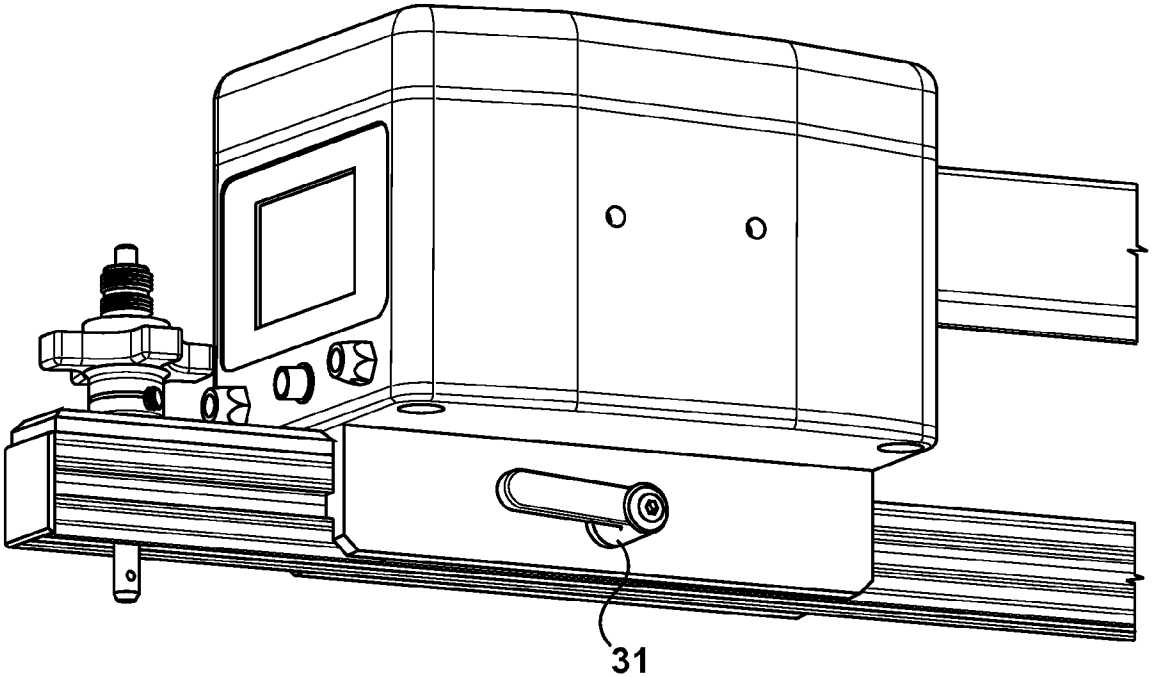
FIG. 9 is a close-up view of a part of the device shown in FIG. 8.

A locking latch may be provided for locking the pointing device at a particular position along the alignment device arm. The locking latch may be of several varieties, for example, as shown in FIG. 9, such as a screw latch 31.

Figure 11:
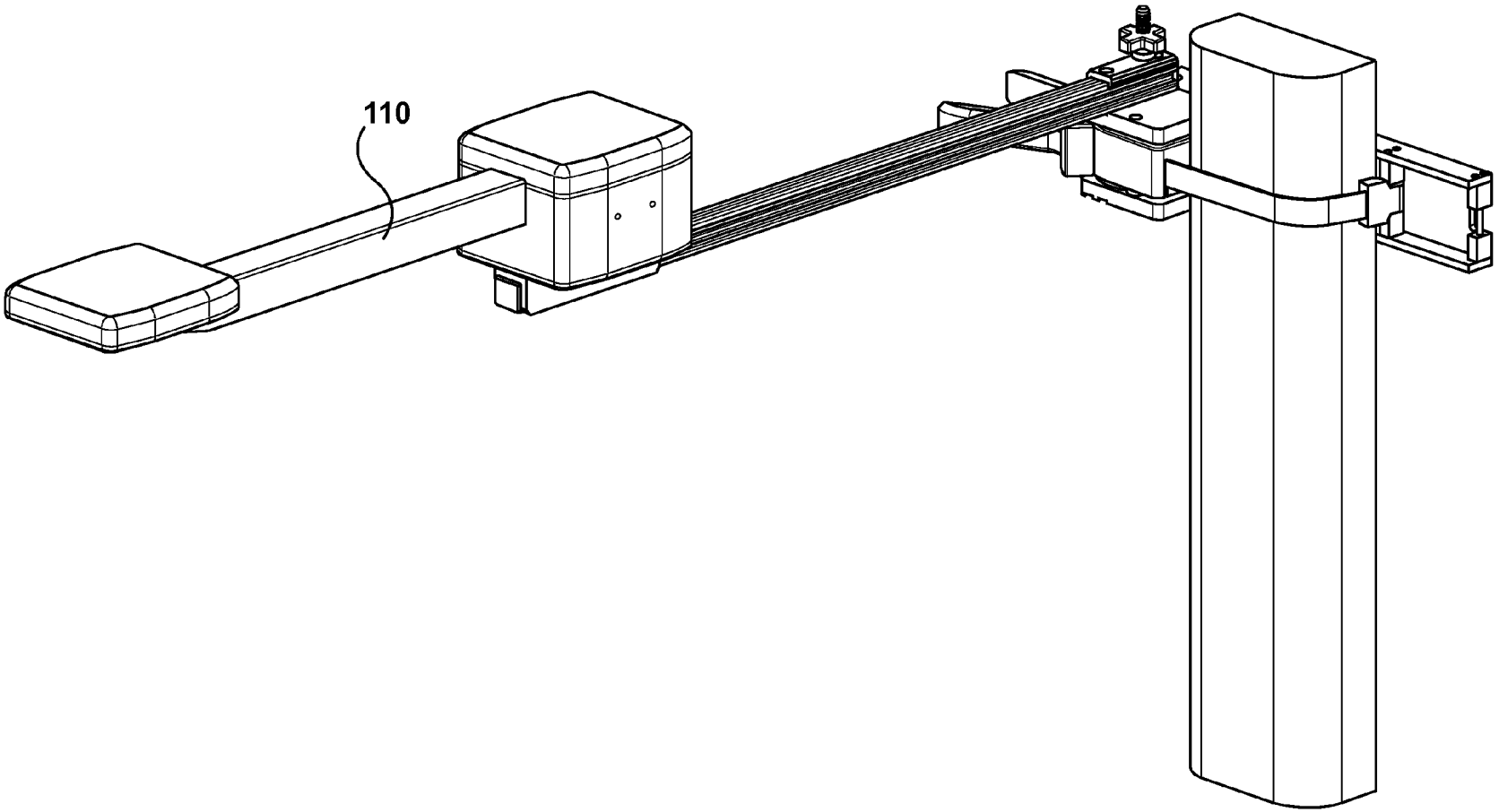
FIG. 11 illustrates the pointing device in an extended configuration.

In one embodiment of the present invention, the alignment device arm may be extendible and the pointing device may be fixedly attached to one end of the arm. As shown in FIG. 10, the pointing device may be positioned in a non-extended configuration. Other positions of the positioning device are also possible, for example, such as that shown in FIG. 11 wherein the alignment pointing device 110 is in an extended configuration.

The alignment device may be permanently fixed to the mounting brace and/or arm of the apparatus, or removeably attached to the mounting brace and/or arm. As shown in FIG. 3, an alignment device attachment guide 33 may be provided on the mounting brace and/or arm for attaching the alignment device thereto in a removable of permanent manner. The alignment device attachment guide may be part of a groove and notch assembly in which one of the groove and notch is formed in the alignment device and the other formed in the alignment device attachment guide. The groove and notch assembly may be slidably engaged to one another.

Figure 17:
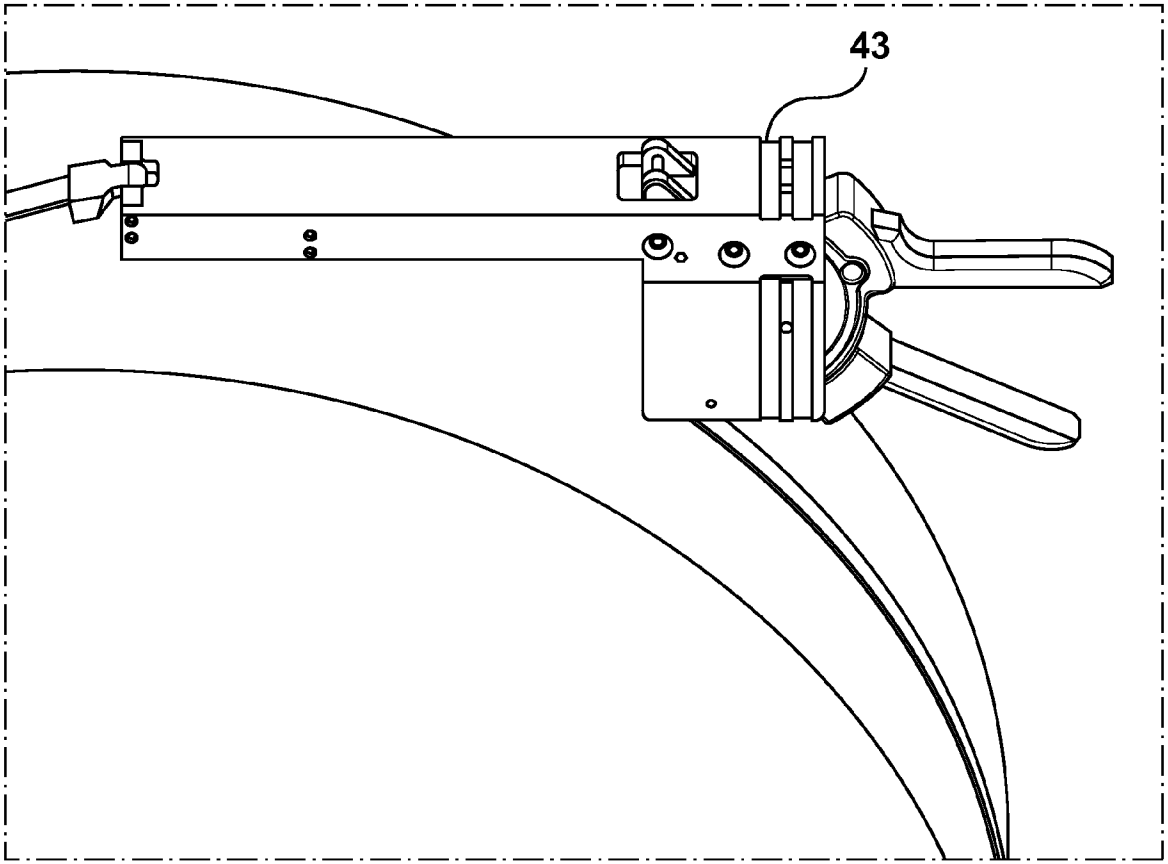
FIG. 17 illustrates a close-up view of the arrangement shown in FIG. 14 without showing the alignment device.

The alignment device attachment guide may be formed in the top and/or bottom plate of the mounting brace. The position of the alignment device attachment guide may cause the alignment device attachment guide to be on the top of the apparatus regardless of whether the alignment device attachment guide is mounted to the left or the right of an antenna when the apparatus is in use. In one embodiment of the present invention, as shown in FIG. 17, a guide 43 that is an alignment device attachment guide may be formed perpendicular to the top plate. In other embodiments an alignment device attachment guide may be formed in the top and/or bottom plate. As an example, an alignment device attachment guide may be formed along the back wall of the mounting brace or the arm to allow for axial mounting. A skilled reader will recognize that other alignment device attachment guide configurations and alignment device attachment guide positioning may also be utilized in the apparatus of the present invention.

In an embodiment of the present invention a locking mechanism may be provided in the alignment device. The locking mechanism may be in proximity of the alignment device attachment guide, and said locking mechanism may be operable to lock the alignment device to the mounting brace once it is coupled to the alignment device attachment guide. The locking mechanism may be operable to secure the alignment device, for example, such as in a secure manner, to the mounting brace to maintain accurate alignment. The locking mechanism may, for example, include a screw and a lever. The mechanism may be screwed in a manner whereby the locking mechanism is tightened and then the lever can be pushed to create subsequent, additional tightness. A level of tight locking may be achieved that will prevent the locking mechanism from unscrewing, un-tightening, and/or becoming too loose to hold the alignment device in place and thereby no longer maintaining accurate alignment. To unlock this type of locking mechanism, the lever may be pulled open and the screw may be unscrewed. A skilled reader will recognize that other types of locking mechanisms may be utilized in the present invention. For example, as shown in FIG. 8, the locking mechanism may include a screw 35 that may be screwed into a hole, for example, such as a screw hole 37 (as shown in FIG. 3) that is incorporated in the mounting brace. Said screw hole may be positioned in proximity of the alignment device attachment guide. The locking mechanism may be an adjustable locking pin.

In one embodiment of the apparatus of the present invention, the apparatus may be positioned in a reference position selected in reference to a reference point, line or plane of the antenna. A bracket of the apparatus may be disposed about an antenna such that an arm connected to the bracket is positioned adjacent to the back wall of the antenna and the mounting brace is disposed adjacent to the left or right side wall or the side of the front wall of the antenna. A means for releasing or extending the strap may be operable by a user. For example, the user may pull the strap around the front wall of the antenna. The strap fastener may then be fastened to the arm fastener. The user may then tighten the strap around the front wall of the antenna by using the tightening mechanism.

The user may slideably engage the alignment device to the top or bottom plate of the mounting brace. The user may utilize the locking mechanism to lock the alignment device and optionally may extend the arm of the alignment device. The user may align the antenna to optimize its alignment. Once aligned, the user may disassemble and remove the apparatus in reverse order of its attachment and assembly.

As previously mentioned, other antennae that may be aligned by the apparatus of the present invention include directional antennae, multi-directional antennae, parabolic antennae, antenna arrays and omni-directional antennae that have a housing defined by one or more walls in which none of the walls are required to be substantially flat. In embodiments of the present invention that utilize such types of antennae, the apparatus of the present invention may align such antennae based on alignment to a reference point, line or plane of the antenna. A user may arrange or otherwise position the apparatus of the present invention with reference to the reference point, line or plane of the antenna and secure the apparatus to the antenna via the securing mechanism to retain the reference positioning during alignment of the antenna, as described herein.

In the case of a multi-directional antenna, parabolic antenna, antenna array and/or omni-directional antenna, the antenna may include directional components that a user wishes to align.

In such instances, the antenna may typically be provided with one or more markings to enable a user to determine a plane in which the directional components relate. Such a plane may be functionally similar to the plane defined by the back wall of a panel antenna.

Figure 12:
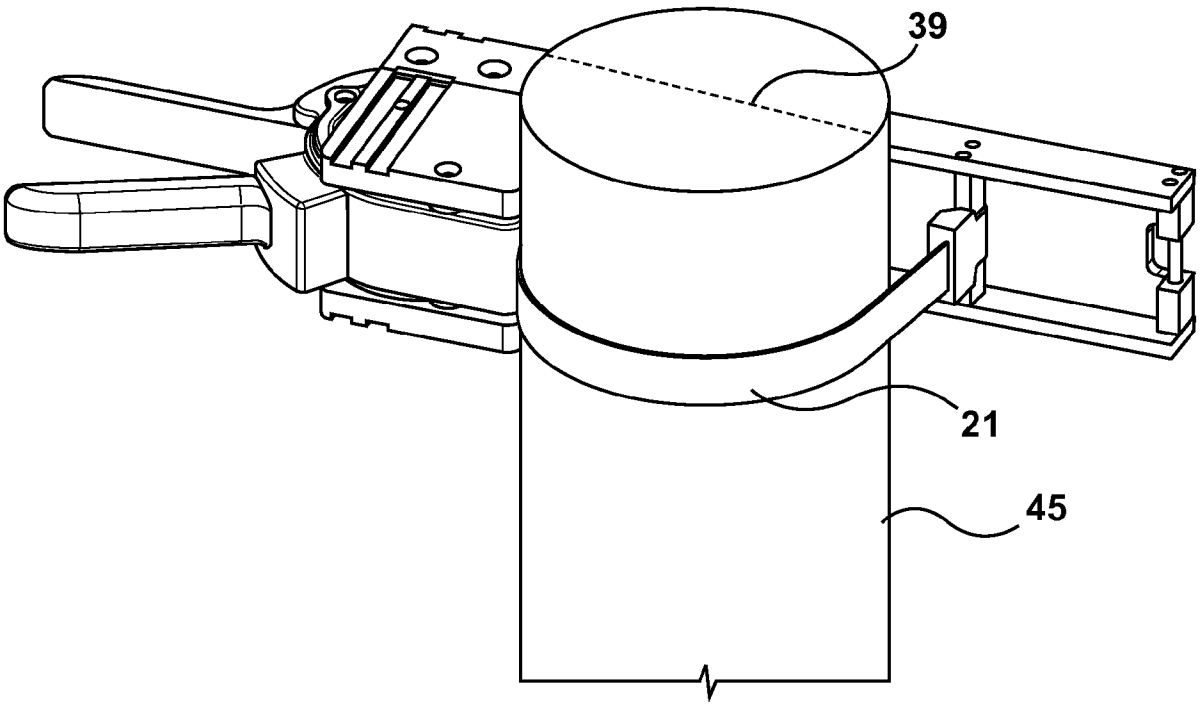
FIG. 12 illustrates a perspective view of an apparatus in accordance with the present invention disposed around an omni-directional antenna housing.

In one embodiment of the present invention, as shown in FIG. 12, an omni-directional antenna may be attached to the apparatus, and such omni-directional antenna may have a reference line 45. The reference line may be utilized to arrange or otherwise position the apparatus. The reference line may indicate the plane along which the directional components are arranged within the antenna. Based on this particular marking, a user may arrange or otherwise position the apparatus to be parallel to a plane 39 formed across the antenna as indicated by the reference line. A skilled reader will recognize that other reference points, lines or planes may be provided on the antenna. For example, the user may adjust the apparatus such that the reference line is tangent to the arm so that angular precision may not adversely affect the alignment precision.

Figure 13:
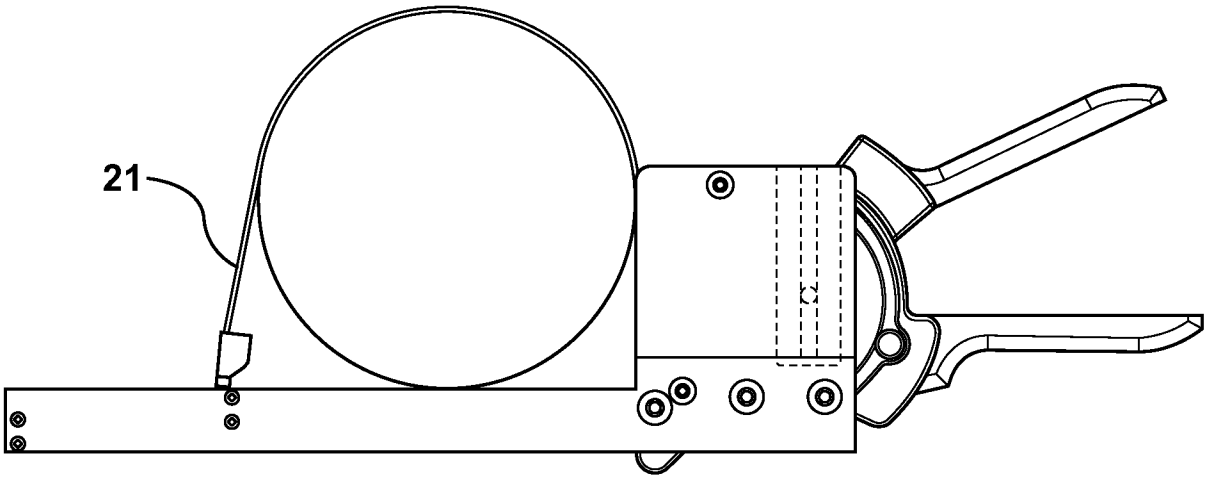
FIG. 13 illustrates a plan view of the arrangement shown in FIG. 12.

In an embodiment of the present invention, wherein the omni-direction antenna is attached to the apparatus of the present invention, the flexible strap 21, may conform to one or more walls of the antenna, as shown in FIG. 13. In this manner the securing means of the apparatus may be operable to secure the bracket to the antenna. When the antenna is attached in this manner and secured to the apparatus, the reference position of the apparatus, which is selected in reference to the plane of the antenna, may be retained during alignment of the antenna.

Figure 14:
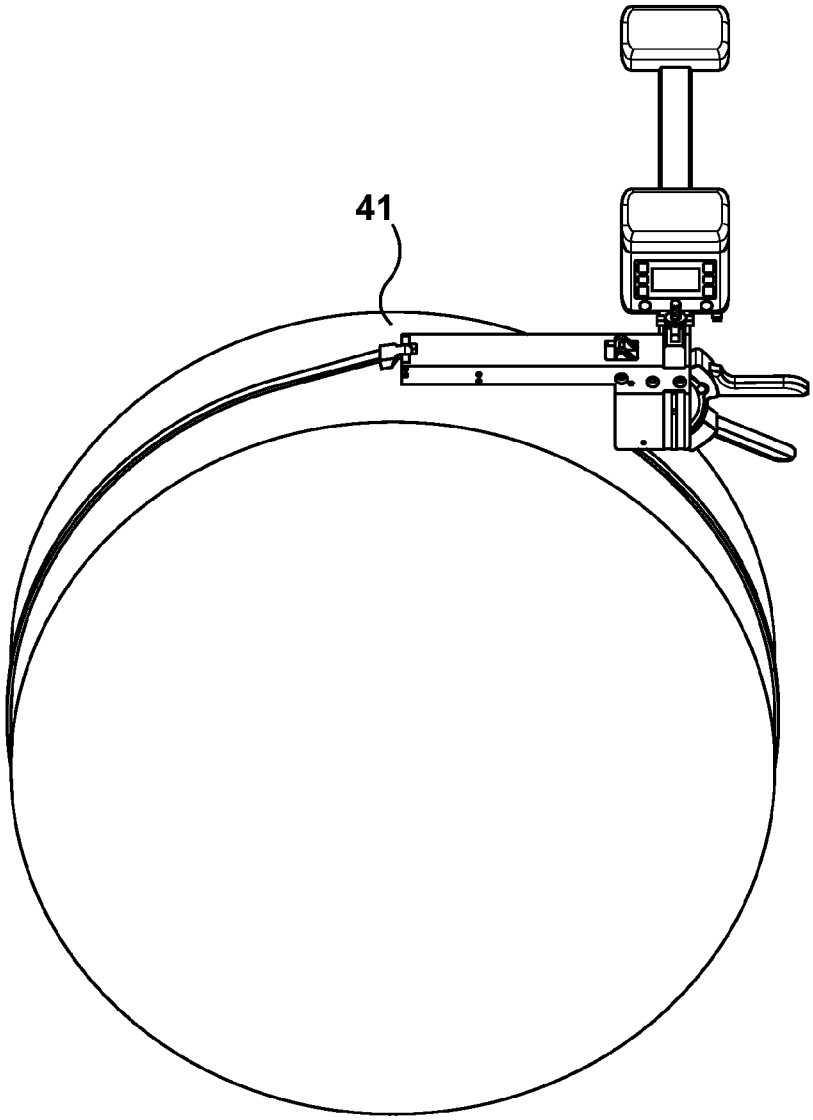
FIG. 14 illustrates a perspective view of an apparatus in accordance with the present invention disposed around an example of a microwave antenna.
Figure 16:
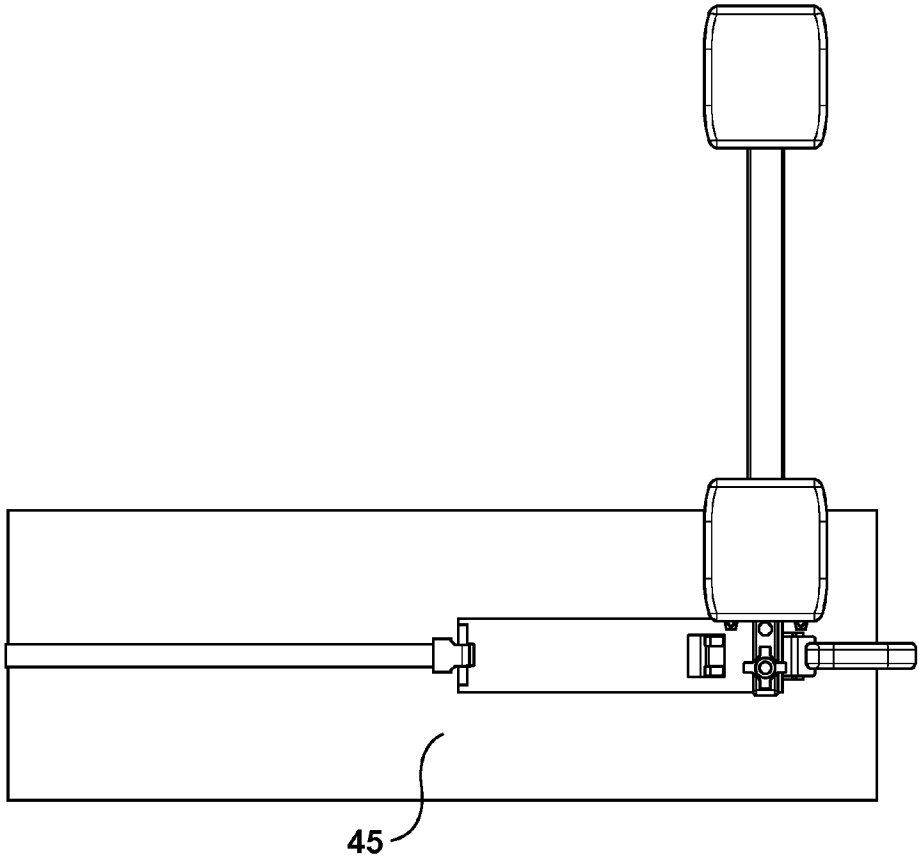
FIG. 16 illustrates a top view of the arrangement shown in FIG. 14.

In another embodiment of the present invention, a microwave antenna may be attached to the apparatus, as shown in FIG. 14. Although the antenna is shown with a flat back wall, a person skilled in the art may recognize that the wall of a microwave antenna may, or may not, be flat. As shown in FIG. 14, a microwave antenna reference line 41 may be provided on the antenna, and the microwave antenna reference line may indicate the direction along which the directional components are arranged within the antenna. Based on this particular microwave antenna reference line marking, a user may arrange the alignment device to be parallel with the microwave antenna reference line. As an example, as shown in FIG. 16, an antenna reference line 45 may be utilized as a reference for the positioning of the alignment device to be parallel, or virtually parallel, with the antenna reference line.

Figure 15:
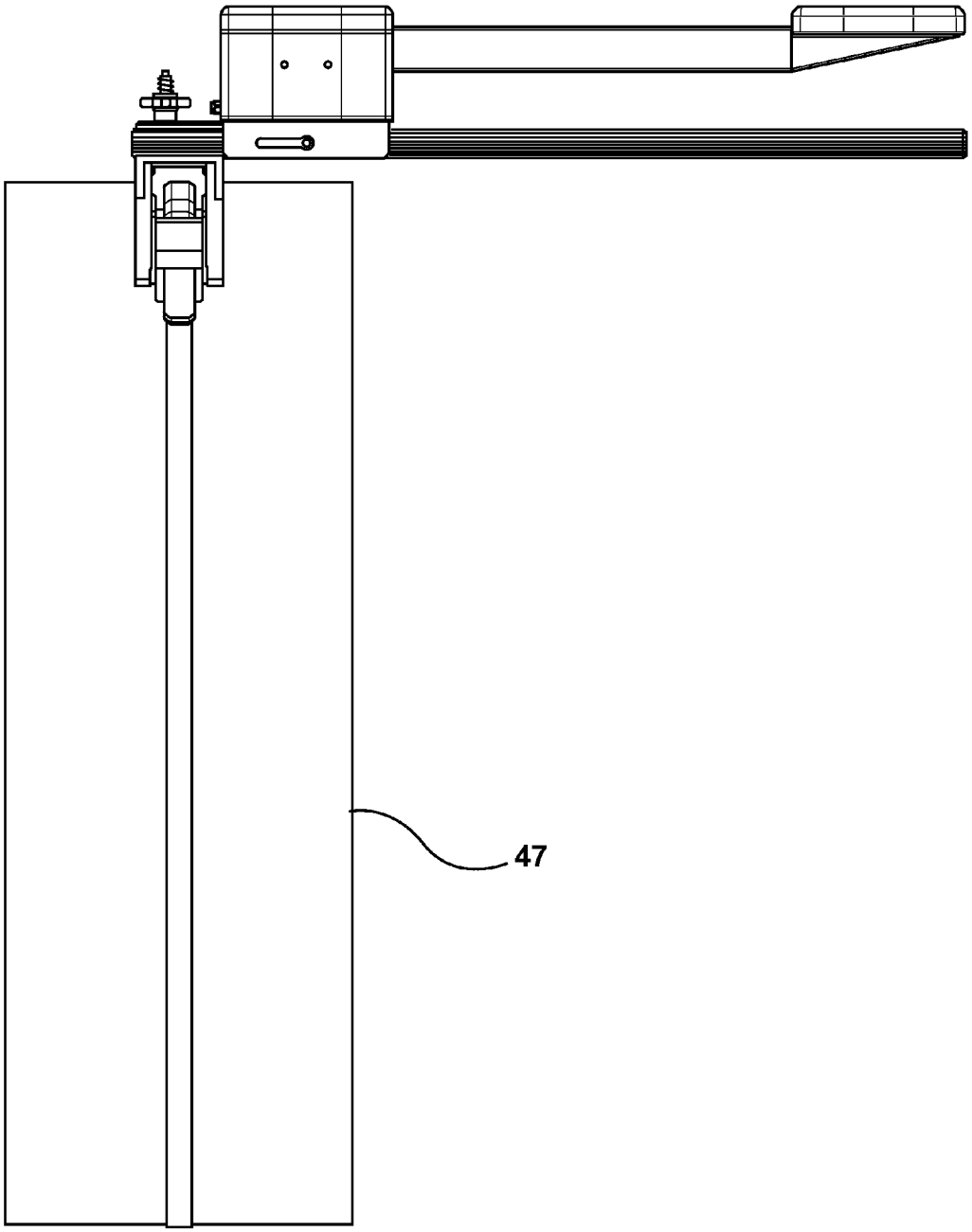
FIG. 15 illustrates a side view of the arrangement shown in FIG. 14.

A skilled reader will recognize that other reference points, lines or planes may be provided on the various types of antenna that may be attached to the apparatus of the present invention. For example, as shown in FIG. 15 a vertical antenna reference line 47 may be indicated along a vertical plane as marked on a side wall of an antenna.

In one embodiment of the present invention, the apparatus may be secured to the antenna in an axial bracket mounting arrangement, whereby the bracket sits on top of the antenna housing, for example, such as a microwave antenna housing, and the bracket is positioned to a point where the roll of the antenna may be zero or null, or virtually zero or null. One means of determining the roll to be zero or null, or virtually zero or null, that may be applied to the present invention may be accomplished by utilizing an integrated bubble level. Such a bubble level may be disposed in the arm of the apparatus. Another means of determining the roll to be zero or null, or virtually zero or null, may be to utilize the alignment device, for example, such as an alignment device that includes a pointing device to measure the roll. For example, the pointing device utilized for this purposes may be an azimuth pointing device. A skilled reader will recognize that a variety of other means for determining the roll of the antenna to be zero or null, or virtually zero or null, may be utilized in accordance with the present invention.

A skilled reader will further recognize that to secure the bracket of the apparatus to the antenna, the securing mechanism may be disposed around the periphery of the antenna, or other arrangements may be utilized as desired and in accordance with the present invention. By tightening the securing mechanism using the tightening mechanism, the arrangement of the apparatus may be retained about the antenna.

It will be appreciated by those skilled in the art that other variations of the embodiments described herein may also be practiced without departing from the scope of the invention. Other modifications are therefore possible.

We claim:

1. An apparatus for removeably retaining an antenna in a reference position that is in reference to a back wall of the antenna during alignment of the antenna, said apparatus comprising:

a) a bracket incorporating a bracket arm being conformable to one or more walls of the antenna, including at least the back wall of the antenna, and a mounting brace substantially perpendicular to the bracket arm;

b) a securing means attached to the bracket, said securing means being operable to retain the antenna in the reference position and including an adjustable flexible strap conformable to one or more of the front and side walls of the antenna, and a tightening mechanism operable to tighten and release the flexible strap to an appropriate tension in relation to the antenna; and c) an alignment device attached to the mounting brace, said alignment device being moveable to a variety of positions, and said alignment device being operable to align the antenna and to determine the alignment of the antenna with reference to the back wall of the antenna.

2. The apparatus of claim 1, wherein the arm is at least as long as the width of the back wall of the antenna.

3. The apparatus of claim 1, wherein the antenna is one of the following: a panel antenna, a directional antenna, a multi-directional antenna, a parabolic, one or more antenna arrays, or an omni-directional antenna.

4. The apparatus of claim 1, wherein the bracket is in contact with one side wall of the antenna, and the bracket conforms to the one side wall of the antenna.

5. The apparatus of claim 1, wherein the reference position is a position that is selected in reference to one or more of the following relating to the antenna; a reference point; a line; or a plane.

6. The apparatus of claim 1, wherein the back wall of the antenna is curved and the bracket is curved to conform to The back wall of the antenna.

7. The apparatus of claim 1, wherein the bracket includes fastener operable to hold the apparatus in a position.

8. The apparatus of claim 1, wherein a frictional engagement material is attached to at least one inner wall of the bracket.

9. The apparatus of claim 1, wherein the bracket includes a locking mechanism operable to lock and hold the alignment device in a specific position.

10. The apparatus of claim 1, wherein the alignment device includes an attachment guide, said attachment guide being connectable to the bracket.

11. The apparatus of claim 1 wherein the alignment device includes a pointing device that is moveable.

12. The apparatus of claim 1, wherein the alignment device is at least one of the following: an optical scope; reflector for surveying; one or more prisms for surveying; prism poles for surveying; one or more cameras; one or more mirrors; and a laser pointer.

13. The apparatus of claim 1, wherein the alignment device includes a pointing device.

14. The apparatus of claim 13, wherein the pointing device is one or more of the following: en azimuth pointing device; and a GPS enabled pointing device.

15. The apparatus of claim 1, wherein the arm is sufficiently long along the back wall of the antenna to maintain alignment accuracies.

* * * * *